US006712675B1

(12) United States Patent
Giurgiuman et al.

(10) Patent No.: US 6,712,675 B1
(45) Date of Patent: Mar. 30, 2004

(54) METHOD FOR GRINDING AT LEAST ONE SURFACE ON A CUTTING KNIFE USED IN MACHINING, USE OF SAID METHOD AND GRINDING WHEEL USED TO CARRY OUT SAID METHOD

(75) Inventors: Horia Giurgiuman, Zürich (CH); Manfred Knaden, Zürich (CH)

(73) Assignee: Oerlikon Geartec AG, Zurich (CH)

( * ) Notice: Subject to any disclaimer, the term of this patent is extended or adjusted under 35 U.S.C. 154(b) by 0 days.

(21) Appl. No.: 09/720,641

(22) PCT Filed: Jun. 22, 1999

(86) PCT No.: PCT/EP99/04327

§ 371 (c)(1),
(2), (4) Date: Dec. 22, 2000

(87) PCT Pub. No.: WO99/67036

PCT Pub. Date: Dec. 29, 1999

(30) Foreign Application Priority Data

Jun. 23, 1998 (DE) ..... 198 27 897

(51) Int. Cl.[7] ..... B24B 3/36

(52) U.S. Cl. ..... 451/48; 451/5

(58) Field of Search ..... 451/48, 548, 541, 451/544, 45, 5, 10

(56) References Cited

U.S. PATENT DOCUMENTS

| | | | | |
|---|---|---|---|---|
| 4,862,868 A | * | 9/1989 | Dodd et al. | 125/11.01 |
| 5,168,661 A | | 12/1992 | Pedersen et al. | |
| 5,241,794 A | | 9/1993 | Pedersen et al. | |
| 5,259,148 A | | 11/1993 | Wiand | |
| 5,305,558 A | * | 4/1994 | Pedersen et al. | 451/48 |
| 5,503,588 A | | 4/1996 | Sweet | |

FOREIGN PATENT DOCUMENTS

| | | |
|---|---|---|
| DE | 3416441 | 4/1986 |
| DE | 4210710 | 9/1993 |
| EP | 0441627 | 8/1991 |

OTHER PUBLICATIONS

English Translation of PCT International Preliminary Examination Report.

(List continued on next page.)

*Primary Examiner*—Robert A. Rose
(74) *Attorney, Agent, or Firm*—John R. Ley

(57) ABSTRACT

A grinding wheel (28) that rotates around an axis and that has a working area consisting of an annular surface with a circular arc profile in axial cross section is used to first generate a surface on a cutting blade (22) by grinding with the annular surface during a first orientation in space between the grinding wheel (28) and the cutting blade (22) by means of at least one first relative translational movement between the same, and subsequently at least one part of the generated surface is reground with the annular surface during a second orientation in space between the grinding wheel (28) and the cutting blade (22) by means of at least one second relative translational movement between the same. The grinding wheel (28) is a diamond cup-type grinding wheel. One part (34') of the working area (34) is located in a face area and another part (34") is located in a cylinder area of the grinding wheel (28). The one part (34') is used for rough grinding and the other part (34") is used for finish grinding of the surface to be generated on the cutting blade (22). The grinding wheel (28) has the same abrasive coating for the entire working area (34). Thus roughing and finishing are performed using areas of the grinding wheel (28) that have the same specifications but different grinding parameters. Preferably, spatial orientation between the grinding wheel (28) and the cutting blade (22) is selected by adjusting the cutting blade (22) in relation to the grinding wheel (28). The method enables planar and/or convex and concave surfaces to be generated on a cutting blade.

24 Claims, 13 Drawing Sheets

OTHER PUBLICATIONS

PCT/ISA/210 –International Preliminary Research Report.

Oerlikon Gear Technology, CNC Werkzeugschleifzelle Oerlikon B22, prior to Jun. 23, 1998, pp. 1–12.

Oerlikon Gear Technology, Universal CNC Gear Tool Sharpening Machine, prior to Jun. 23, 1998, pp. 1–8.

Oerlikon Gear Technology, CNC–Verzahnwerkzeug–Schärfmaschine, prior to Jun. 23, 1998, pp. 1–2.

Oerlikon Gear Technology, CNC Tool Grinding Cell, B22, pp. 1–12.

Oerlikon Gear Technology, Technical Description Oerlikon profil B5, CNC Gear Tool Sharpening Machine.

* cited by examiner

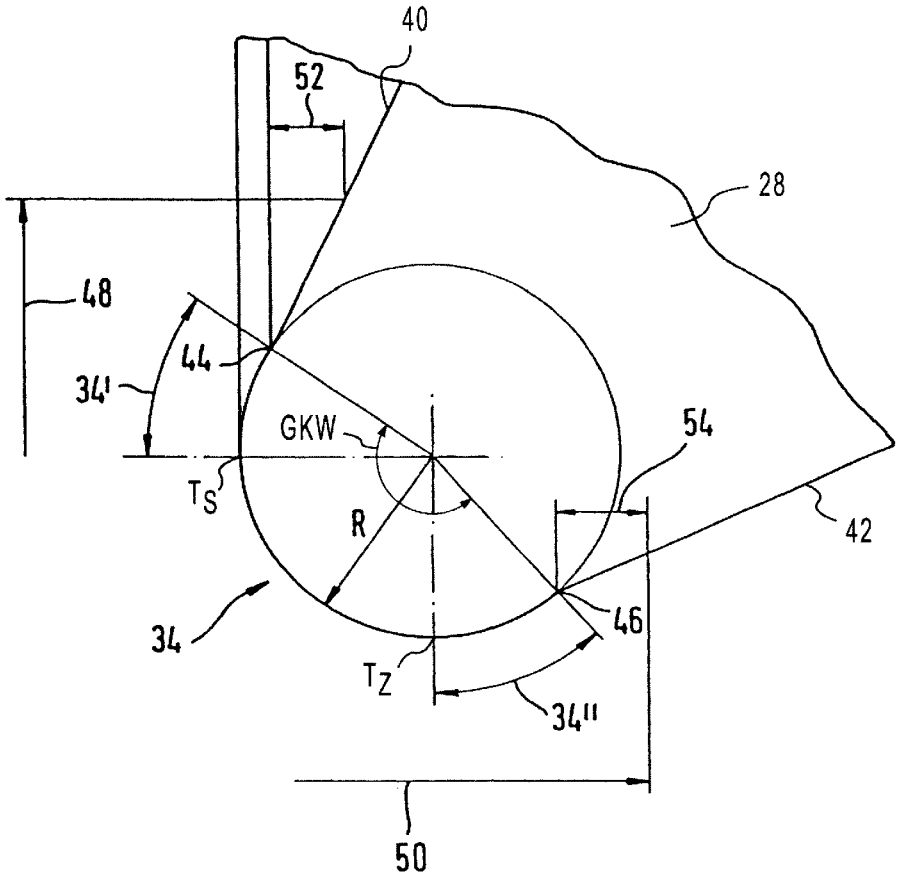
FIG.4
FIG.6a
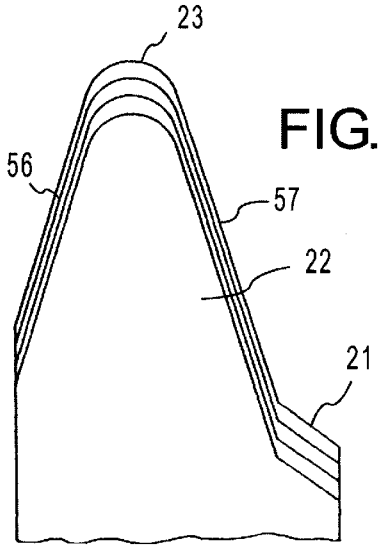
FIG.6b
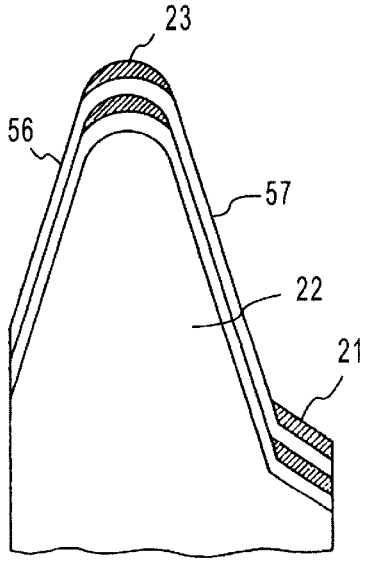

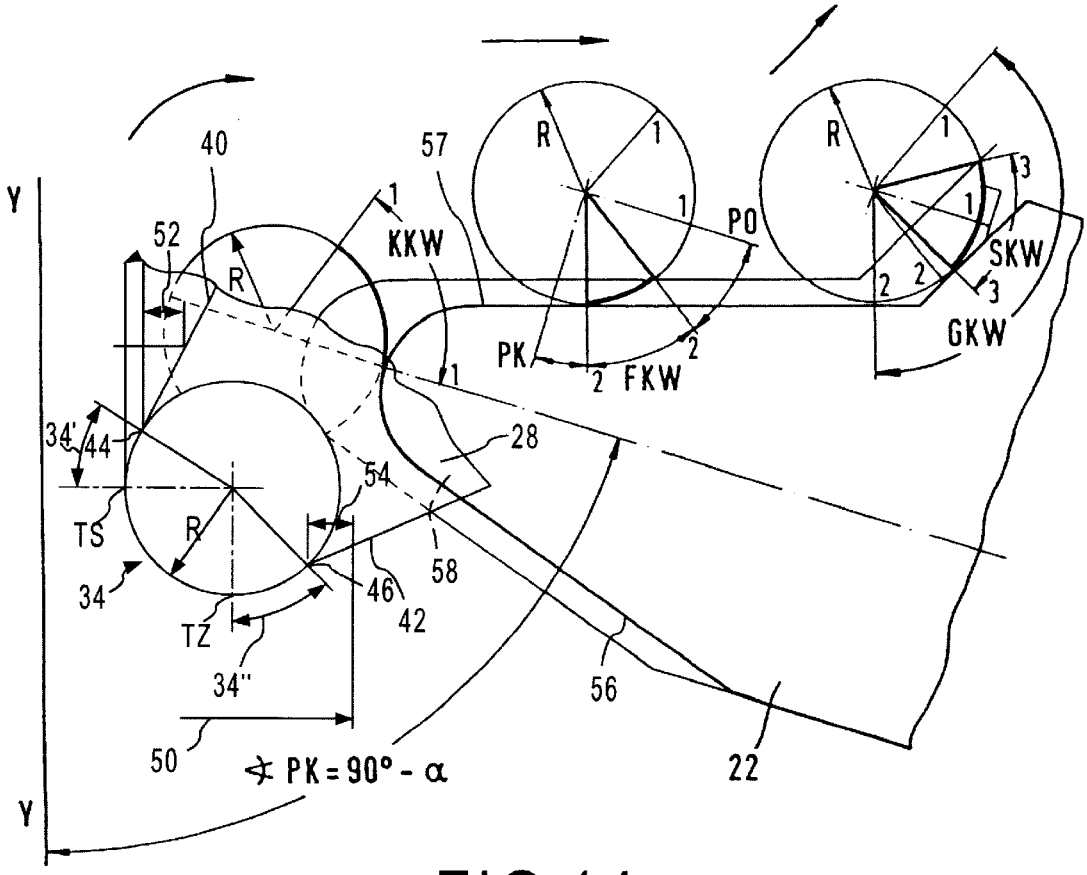
FIG. 14
FIG. 16a
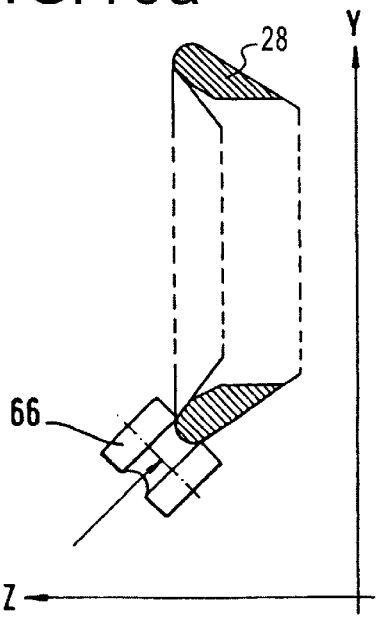
FIG. 16b
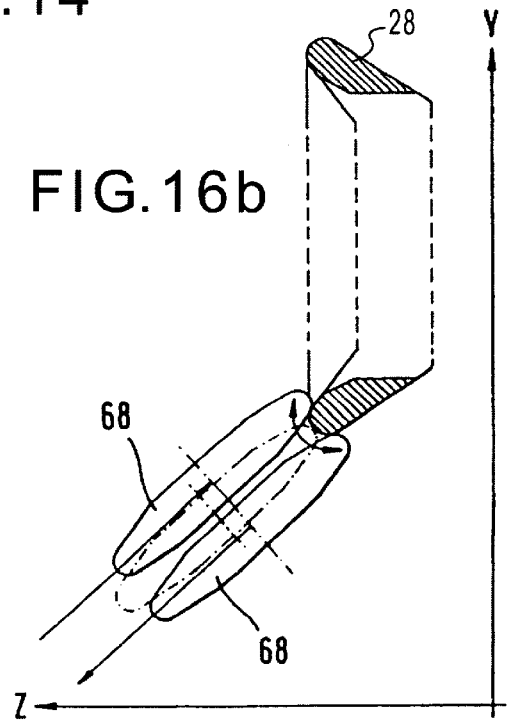

METHOD FOR GRINDING AT LEAST ONE SURFACE ON A CUTTING KNIFE USED IN MACHINING, USE OF SAID METHOD AND GRINDING WHEEL USED TO CARRY OUT SAID METHOD

This invention refers to a method for grinding at least one surface on a cutting blade used in machining, with a grinding wheel that rotates around an axis and that has a working area consisting of an annular surface to an advantageous use of said method; and to a grinding wheel used to carry out said method.

There are currently two techniques for grinding cutting blades used in machining, namely form grinding and generating grinding. The main difference between these two grinding techniques is that in form grinding the generatrix is produced on the tool in advance (dressing). In this manner a simple process is created in which the grinding tool carries the profile. Only one feed motion is then required to form a surface. Contrary to this, in generating grinding the generatrix is produced by at least two machine motions, which complicates the process. However, generating grinding is more flexible than form grinding, since a variety of profiles can be produced by any combinations of movement. The increased flexibility is highly desirable if small or medium-sized batches of special profiles have to be produced. In this case it is not necessary to dress the generating profile into the grinding wheel. However, generating grinding requires more elaborate control than form grinding.

A method of the above-given type is known from U.S. Pat. No. 5,168,661. In this known method a special grinding wheel configuration and a particular sequence of motions are utilized in moving the cutting blade relative to the grinding wheel, to enable the formation of a plurality of desired surfaces on a cutting blade. Furthermore, spiral-shaped furrows produced on the workpiece surface by the grain protruding highest from the grinding wheel are to be avoided. For this purpose, the known method utilizes a profile grinding wheel which is described and illustrated in the aforementioned U.S. Pat. No. 5,168,661, but which is claimed in U.S. Pat. No. 5,241,794. This known profile grinding wheel has a grinding profile which for finish grinding has a narrow, substantially flat surface on the outer portion of the wheel surface. This flat surface is kept substantially tangent to a workpiece surface during finish grinding. This profile grinding wheel consists of an expensive, highly durable abrasive material such as CBN crystals. However, other materials such as aluminum oxide can also be used, since the profile grinding wheel does not need to be dressed. Aside from the narrow, flat surface used for finish grinding, the working area of the known profile grinding wheel has an inner conical surface, an inner arcuate surface and an outer arcuate surface. The inner conical surface, the inner arcuate surface and/or the outer arcuate surface is/are used for rough grinding. The roughed blade surface is subsequently finished with the narrow flat surface.

This known method requires a complex sequence of movements, since every surface to be ground on the cutting blade is first roughed at least with the inner conical surface and subsequently finished with the narrow flat surface. The profile grinding wheel utilized in the known method comprises materials with different grain sizes in their rough grinding and finish grinding areas. The roughing and finishing work to be performed by the known profile grinding wheel is thus distributed over two different grinding wheel areas, of which the one area is used only for rough grinding and the other only for finish grinding. The cutting blades ground with the known method are common high-speed steel blades. A further disadvantage of the known method is that it is not possible to finish grind concave surfaces, since the finish grinding is always performed with the narrow flat surface. Another disadvantage of the known generating grinding method is that because of the CBN wheels employed in this method, cemented carbide blades can not be ground. A CBN wheel would not be adequately stable for machining cemented carbide blades. However, cemented carbide blades can not easily be form ground either. A broad diamond wheel would be necessary to form grind cemented carbide blades. However, such diamond wheels are very difficult to condition.

For example, to produce the teeth of a gear it can be necessary to use six different types of blades in order to produce six different profiles. These six profiles could be produced on a borazon grinding wheel by reprofiling. This would not be economical on a diamond grinding wheel. Instead, several different diamond wheels would have to be provided for the form grinding.

The object of the invention is to provide a method of the type given above, having a simpler machining cycle and enabling use of a more simply configured grinding wheel, and particularly permitting grinding to be performed on curved surfaces as well. Furthermore, an advantageous use of the method and a grinding wheel for carrying out said method are to be provided.

Contrary to the known method using a grinding wheel with a complex configuration, in the method according to the invention a universal grinding wheel can be used which has a working area consisting of an annular surface, the axial cross section of which has an arcuate profile. With the method according to the invention a surface is first generated on the cutting blade by grinding with the annular surface during a first orientation in space between the grinding wheel and the cutting blade by means of at least one first relative translational movement between the grinding wheel and the cutting blade, and then at least one part of the generated surface is reground with the annular surface during a second orientation in space between the grinding wheel and the cutting blade by means of at least one second relative translational movement between the grinding wheel and the cutting blade. According to the invention, in this manner a surface can be ground with one area of the annular surface, and it can then be reground with another area of the annular surface. The grinding wheel utilized in the method of the invention does not have to have different specifications for this in these two areas. This is because the same surface of the cutting blade can be ground and subsequently reground, that is roughed and finished, for example, solely through selection of the appropriate parameters together with the two different spatial orientations. This is true irrespective of whether the completed surface is planar, convex or concave. The grinding wheel used in the method of the invention needs only one radius in its working area, and it therefore has a substantially more simple configuration than the grinding wheel used in the known method. The process in the method according to the invention is likewise substantially simpler than in the known method, since just two different spatial orientations can be selected, for example by choosing a different angle for the cutting blade in relation to the grinding wheel. Thus, the method according to the invention is far more flexible in use than the known method. The spiral-shaped furrows, which are avoided in the known method by complicated means, are also avoided by the method according to the invention, without the necessity of using a grinding wheel with a narrow flat surface for the finish grinding.

It is possible to generate cemented carbide blades using the present invention. This is a very significant application of the method according to the invention, since dry milling, in which cutting blades of cemented carbide have to be used, is becoming increasingly common in gear production. Cemented carbide can only be machined with diamond, but diamond profile grinding wheels can hardly be profiled by dressing. Therefore, profile grinding of cemented carbide blades is virtually ruled out. Thus, simply by utilization of a diamond grinding wheel, the method according to the invention can be implemented not only for the generating grinding of cutting blades of high-speed steel, but also for that of cemented carbide cutting blades.

According to the invention, the grinding wheel used to carry out the method has a working area similar to the one provided on a grinding wheel from U.S. Pat. No. 5,259,148, which is provided for the generating grinding of glass lenses. The use of such a diamond cup-type grinding wheel with a working area located partly in a face area and partly in a cylinder area of the cup-type grinding wheel offers the advantage that planar or curved surfaces can be ground (with the face area) or alternatively concave surfaces can be ground (with the cylinder area or the face area on cutting blade used in machining), depending on the spatial orientation between the grinding wheel and the cutting blade. The wear performance improves with a diamond grinding wheel and the wheel geometry becomes more stable than in the known CBN profile grinding wheel. The diameter of the so-called profiling point, which can be precisely determined, no longer changes during a technological phase as compared to a CBN profile grinding wheel. Therefore, it is not necessary to compensate the position of the diamond grinding wheel. Furthermore, a blade shoulder with a larger over measure can be produced in a separate technological phase, thus contributing to increased economic feasibility of the process.

Since in the grinding wheel according to the invention, the working area consists of an annular surface having an arcuate profile in axial cross section which extends across a total contact angle, the roughing and finishing work areas of the grinding wheel can be displaced relative to one another or even separated within this working area by selection of different profile tilting angles. Due to the total contact angle of approximately 145°, the part of the working area being used can be selected in the face area and/or the cylinder area of the grinding wheel. Due to the circular arc profile provided in the grinding wheel according to the invention, with a radius of curvature lying within a range of 0.5 to 5 mm and preferably from 0.5 to 1 mm, and most preferably 0.5 mm or less, possibilities for flexibility in the machining of the cutting blade are offered The cutting blades to be ground using the method according to the invention can consist of different types of cemented carbide.

A blade flank generated with the grinding wheel according to the invention can comprise one or more geometric surfaces. The surface and flank shape is produced by the relative positioning of the grinding wheel and the cutting blade. In this sense the cylinder area of the grinding wheel generates a concave surface, whereas the face area can generate a curved or a planar surface. Therefore, the blade flank can comprise two or more than two different surfaces (for instance a concave surface with a larger relief angle, and a planar facet with a smaller relief angle).

In an advantageous embodiment of the method according to the invention, the first orientation in space between the grinding wheel and the cutting blade is obtained by setting a first position of the cutting blade in relation to the grinding wheel, and the second orientation in space between the grinding wheel and the cutting blade is obtained by setting a second position of the cutting blade in relation to the grinding wheel. In this case, a conventional grinding machine can be used in which the grinding wheel is rotatable around its own axis and is movable in the Y-axis.

In another advantageous embodiment of the invention, the first position of the cutting blade is selected such that the grinding wheel generates the surface on the cutting blade with a first surface element of the annular surface located in a cylinder area of the grinding wheel, and the second position of the cutting blade is selected such that the grinding wheel grinds the at least one part of the surface generated on the cutting blade with a second surface element of the annular surface located in a face area of the grinding surface. In this case, the concave surface generated with the cylinder area can alternatively be reground with the face area in such a manner that the generated surface remains concave or becomes planar or at least partly planar.

In a further advantageous embodiment of the invention, the second position of the cutting blade is selected such that the grinding wheel generates the at least one part of the surface generated on the cutting blade as a concave or planar facet. In this case, only the spatial orientation between the grinding wheel and the cutting blade needs to be selected accordingly.

In an additional advantageous embodiment according to the invention, the stock removal during generation of a surface on the cutting blade occurs only through infeed in a Y-axis of the machine. In this case, the generating grinding process can be easily controlled.

In another advantageous embodiment according to the invention, the surface on the cutting blade is generated only with three mutually orthogonal linear axes, and other axes are utilized merely as adjustment axes and are positioned prior to the actual generating grinding of the surface on the cutting blade. In this case, every desired surface can be generated on the cutting blade with three controlled linear movements on a conventional grinding machine such as that of type B22 of the applicant (cf. the company brochure "CNC-Werkzeugschleifzelle Oerlikon B22" OGT-B22/D/hJ) or type B5 of the applicant (cf. the two company brochures, both entitled "profil B5", sections 1.11-d/e-cH and OGT-profil B5/E/dH, respectively).

In a further advantageous embodiment according to the invention, the surface on the cutting blade is generated in the one and/or the other step in two operations by means of two first and two second relative translational movements between the grinding wheel and the cutting blade, respectively. In this case, the surface can be roughed and finished in two steps each.

In an additional advantageous embodiment according to the invention, the method is carried out on a CNC machine. In this case, the grinding process can be controlled in a conventional manner with regard to the geometry and the technology.

In another advantageous embodiment according to the invention, a CDS computer system (CDS is the abbreviation of Controlled Disk System) is used to determine interrelations between geometric and technological parameters for the generating grinding. In this case, a special software package is all that is required to convert a conventional grinding machine, such as the aforementioned type B22, to the generating grinding according to the invention.

In another advantageous embodiment according to the invention, the surface on the cutting blade is generated in the one step with at least one roughing cut, and the at least one part of the generated surface is reground with a finishing cut in the other step. In this case, each surface can be generated separately and the macro and micro surface geometries can be separately influenced.

In another advantageous embodiment according to the invention, the relative translational movement between the grinding wheel and the cutting blade is produced by imparting a thrust or pulling motion to the cutting blade relative to the grinding wheel. In this case, the desired simple machining cycle can be achieved by the corresponding selection of this motion.

In another advantageous embodiment according to the invention, a pulling motion relative to the grinding wheel is imparted to the cutting blade during regrinding with a finishing cut. Although this is preferred, a thrust motion can be advantageous for the finishing cut instead of the pulling motion, depending on the surface to be ground. Each technological phase (roughing or finishing) can be separately defined geometrically and technologically in the advantageous embodiments of the method according to the invention.

In another advantageous embodiment according to the invention, a grinding wheel is used which has the same specifications over its entire annular surface used for grinding. In this case, it is advantageous to select the roughing cut and the finishing cut solely through selection of feed parameters such as direction and rate of feed.

In yet another advantageous embodiment according to the invention, roughing and finishing are interchangeable in the two steps of the method according to the invention and, therefore, so are the surface elements of the annular surface used for grinding. To be sure, two technological phases, roughing and finishing, could be required. However, the technological process can include a plurality of roughing cuts and one finishing cut and vice versa.

In another advantageous embodiment of the grinding wheel according to the invention, the grinding wheel has a fixed geometry and can not be dressed. This makes its production especially simple. It is far easier to perform grinding with only one specific radius if the radius is kept constant. This is the case with diamond grinding wheels, which have a long service life. It can be assumed that the method is carried out with a constant radius, which simplifies and facilitates the process control. The question of whether a dressable or nondressable grinding wheel is used depends on the grinding capacity of the grinding wheel.

A nondressable grinding wheel preferably comprises a metallic carrier body onto which an abrasive coating of diamond grit and a galvanic bonding from which the diamond grit protrudes is applied, with the galvanic bonding preferably consisting of nickel.

A dressable grinding wheel can be used instead of a nondressable grinding wheel. That is quite possible due to the design of the type B22 machine, since it has a suitable dressing means, and suitable dressing software is provided to permit occasional dressing of the grinding wheel in order to reprofile its radius.

Embodiments of the invention are described in greater detail below with reference to the drawings, wherein:

FIG. 4 shows an enlarged detail drawing of the working area of the grinding wheel according to the invention;

Figure 1:
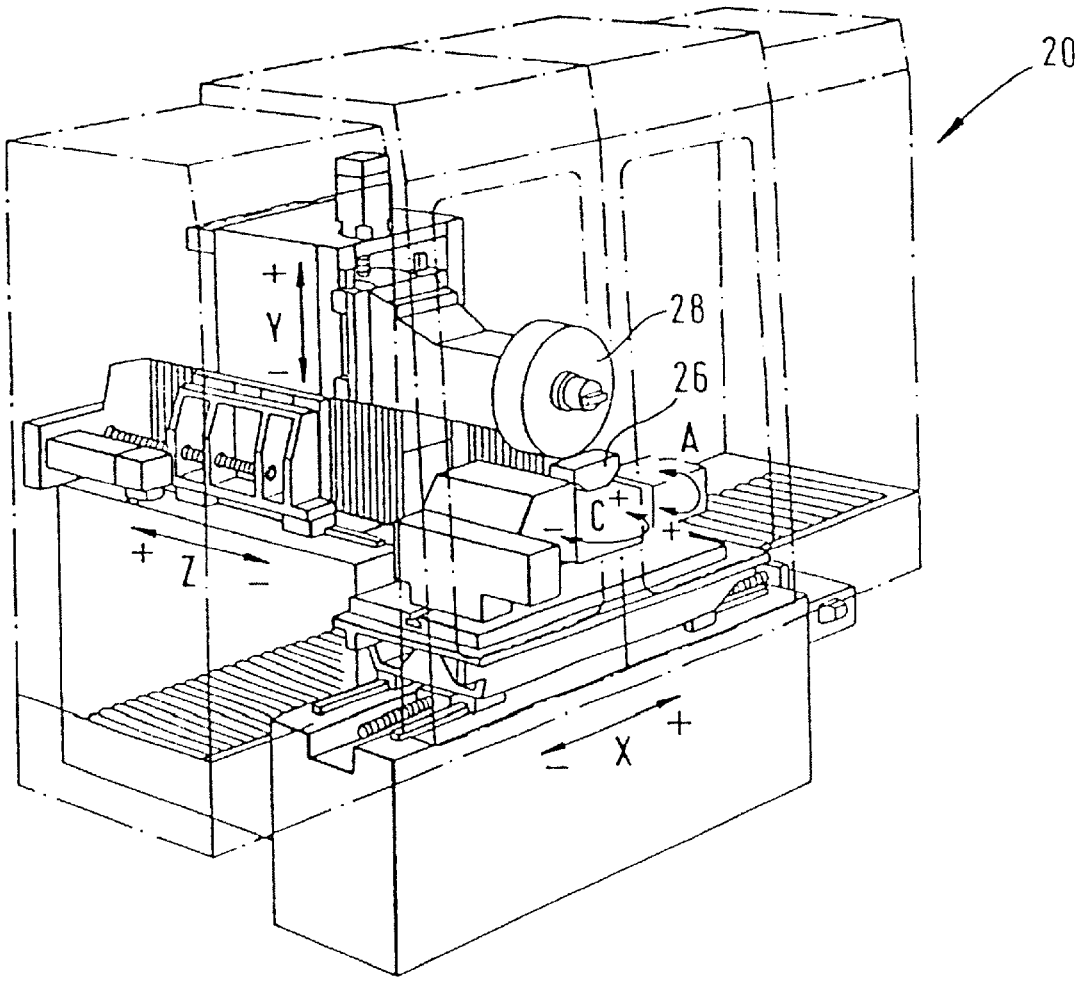
FIG. 1 shows a conventional grinding machine type B22 of the applicant, which has been equipped by further development of its software to carry out the method according to the invention.
Figures 5A, 5B, 5C:
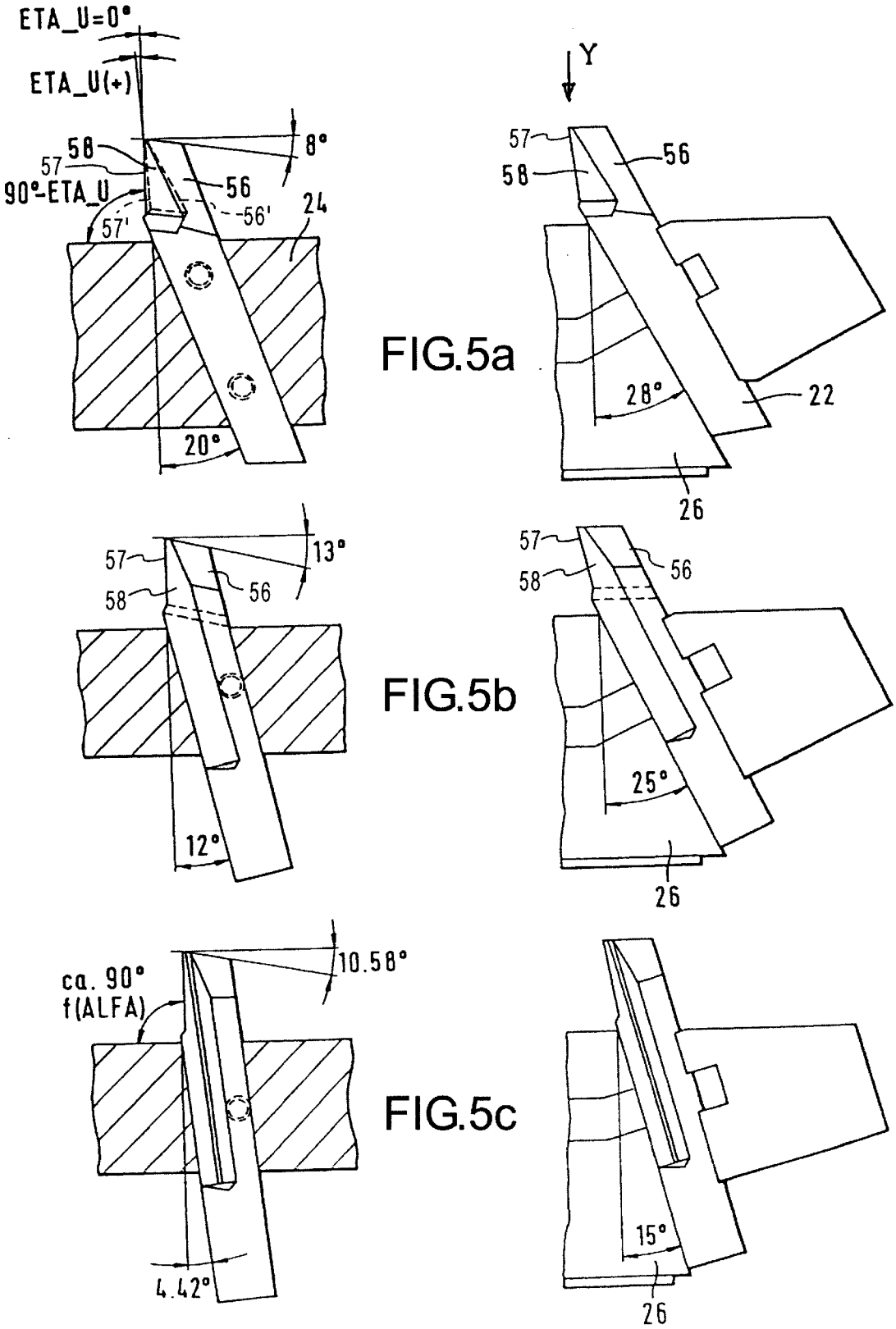
Figure 7:
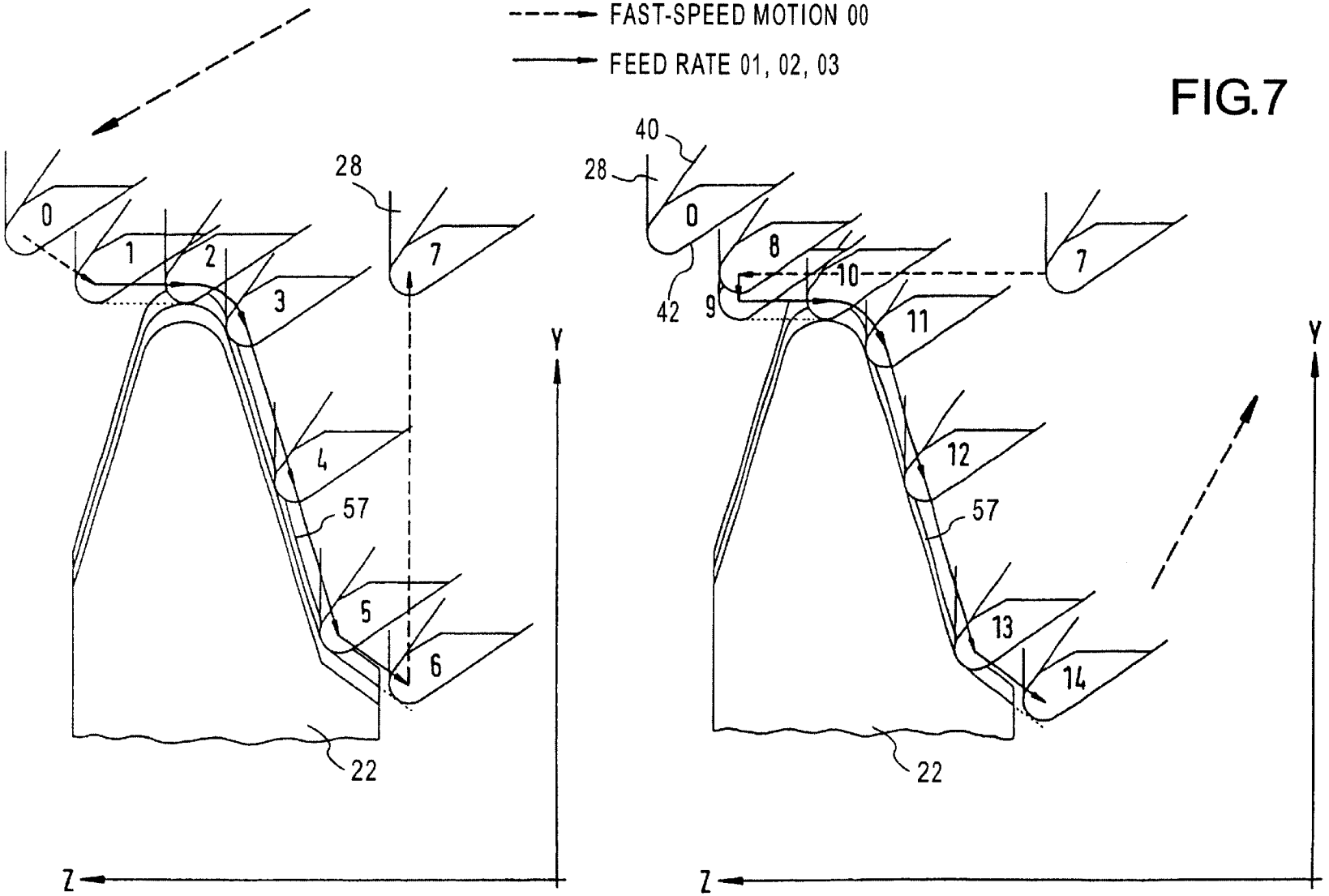
Figure 8:
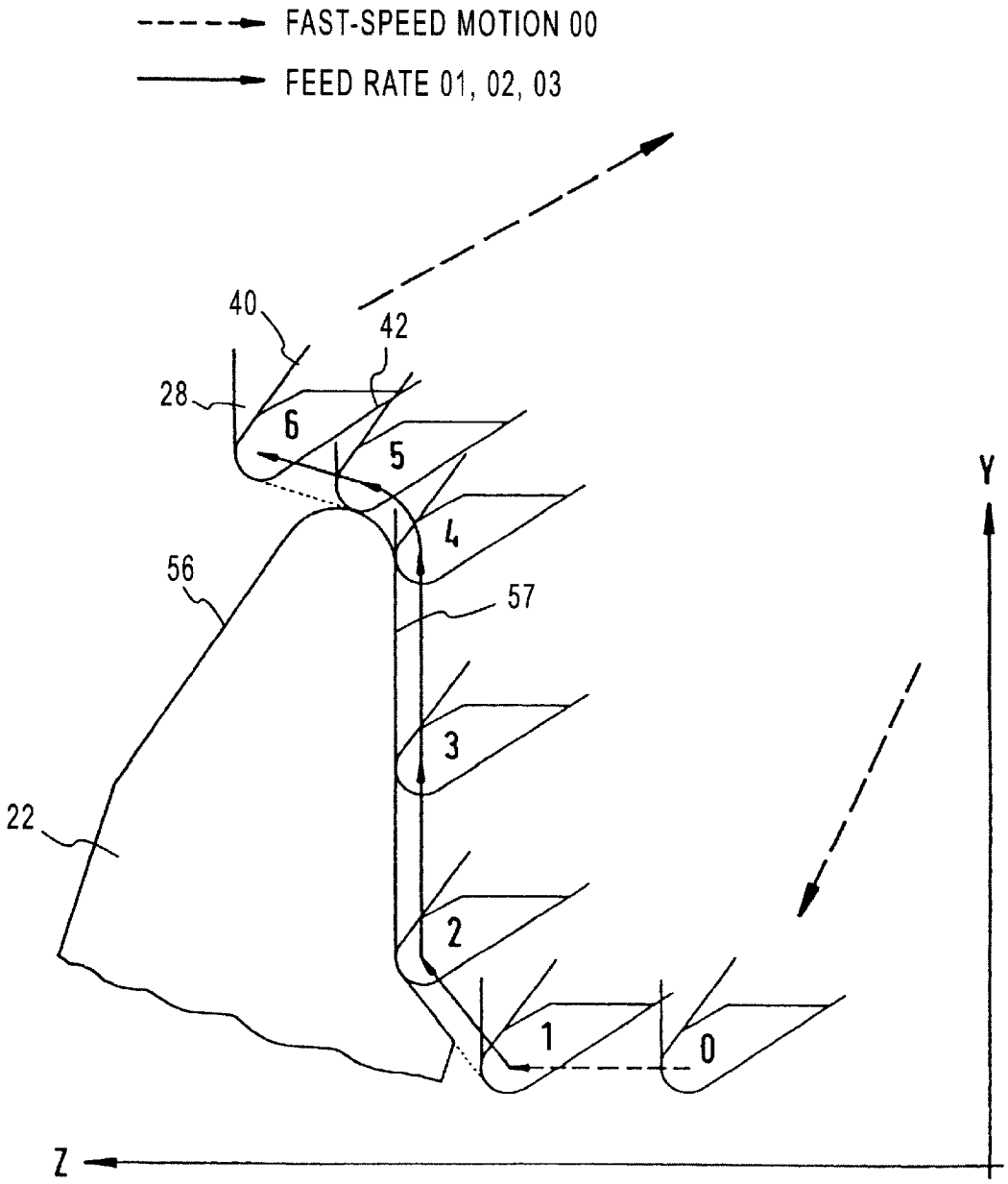
Figure 9:
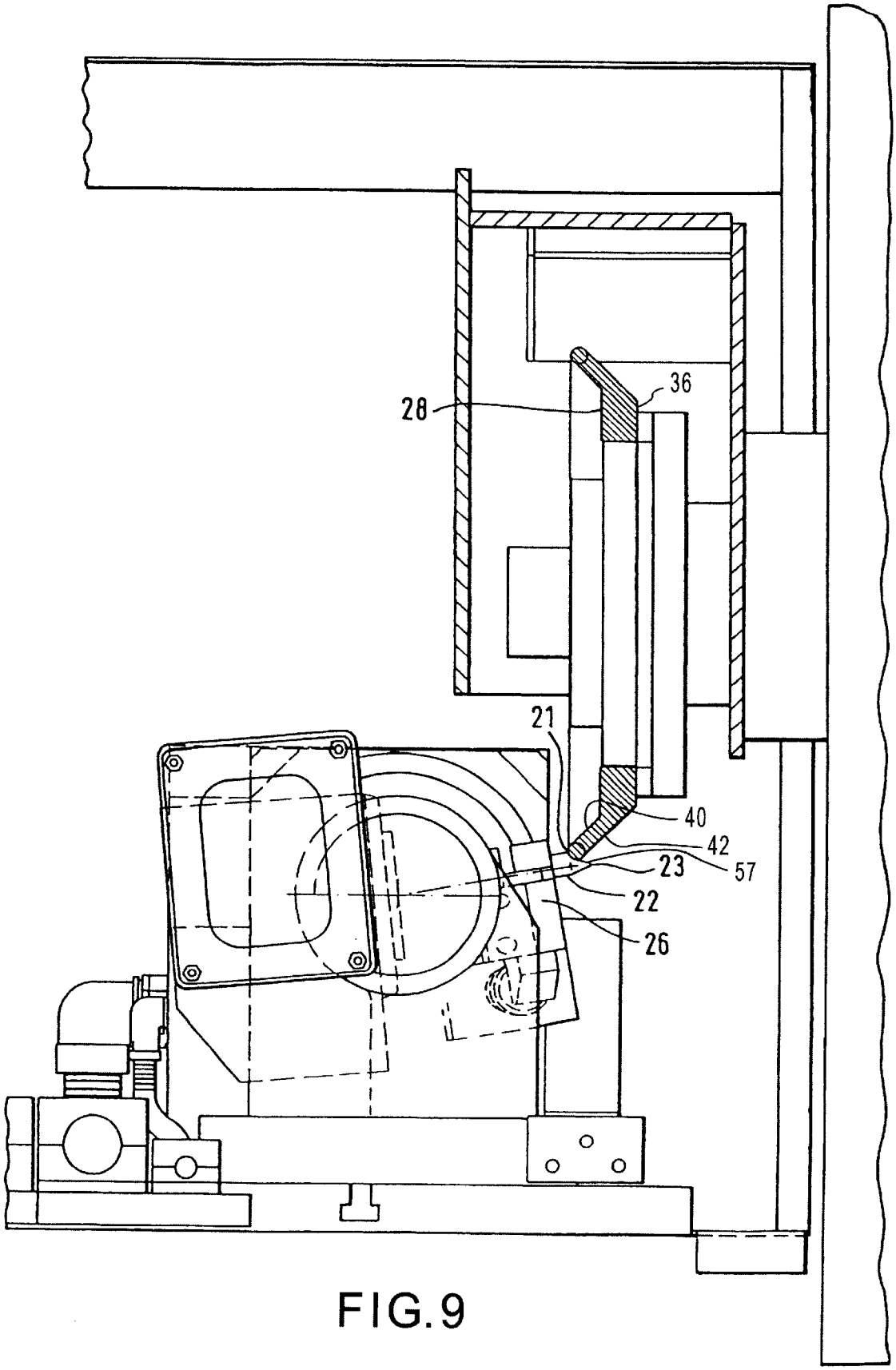
Figure 10:
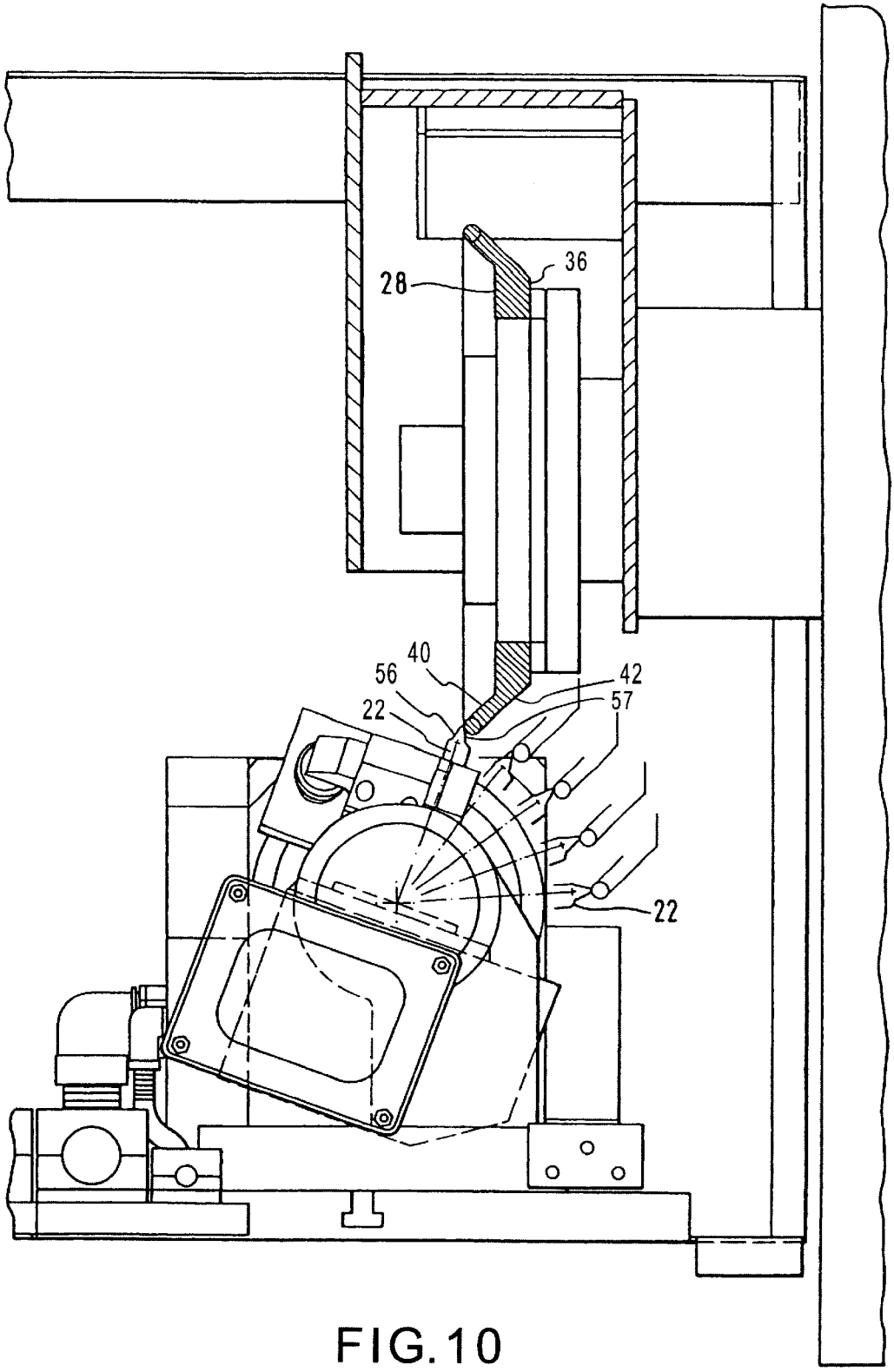
Figure 11:
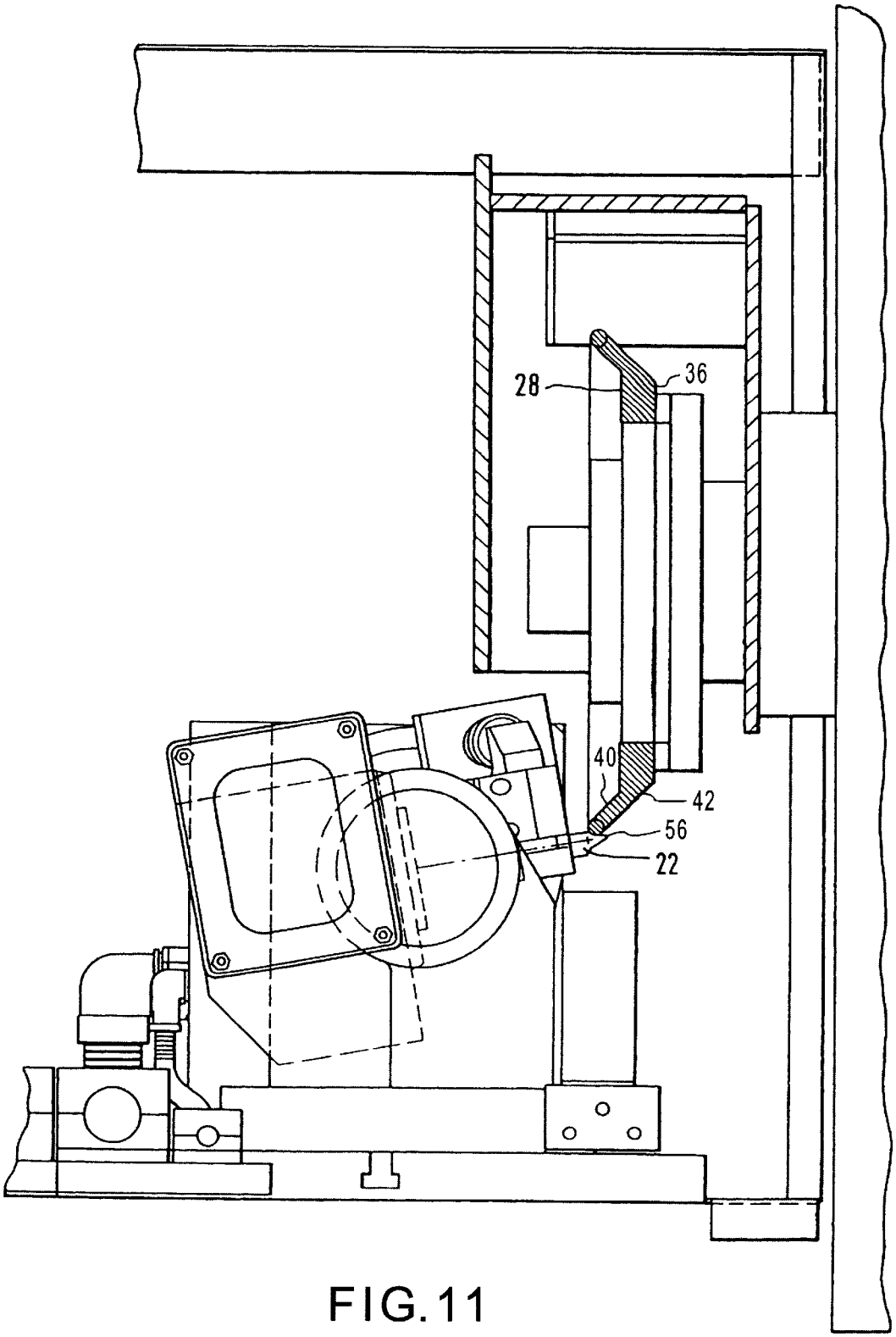
Figure 12:
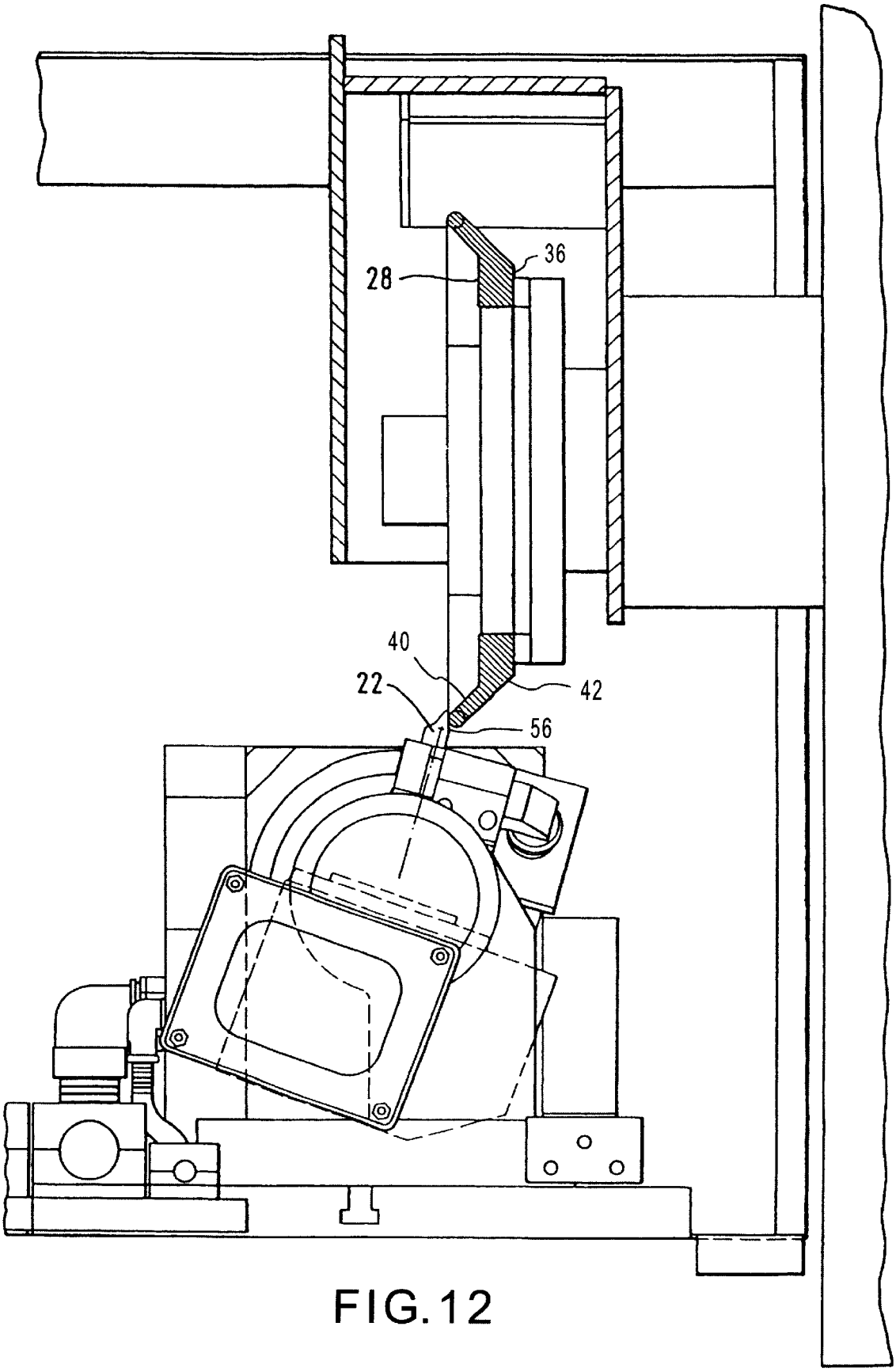
Figure 13:
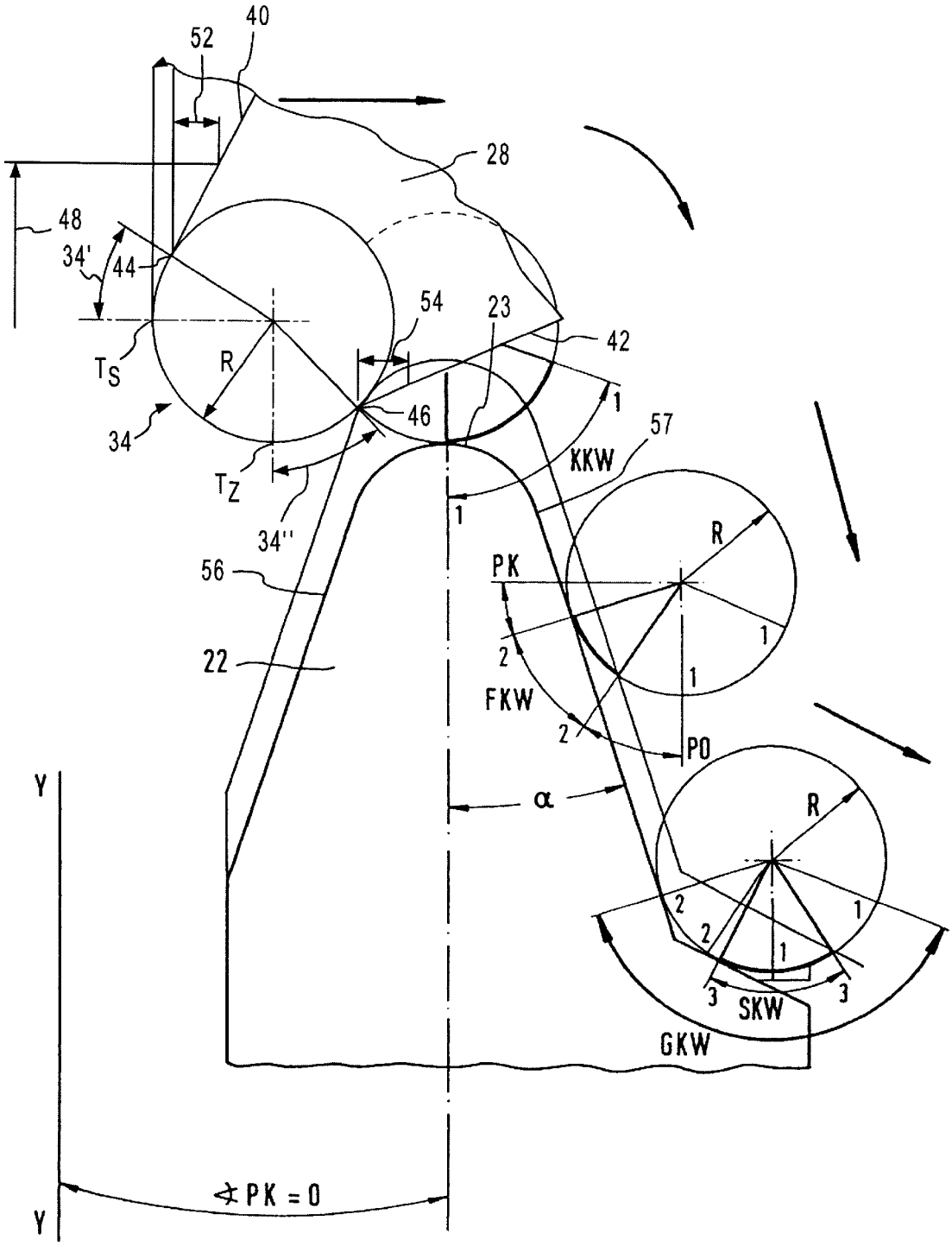
Figure 15:
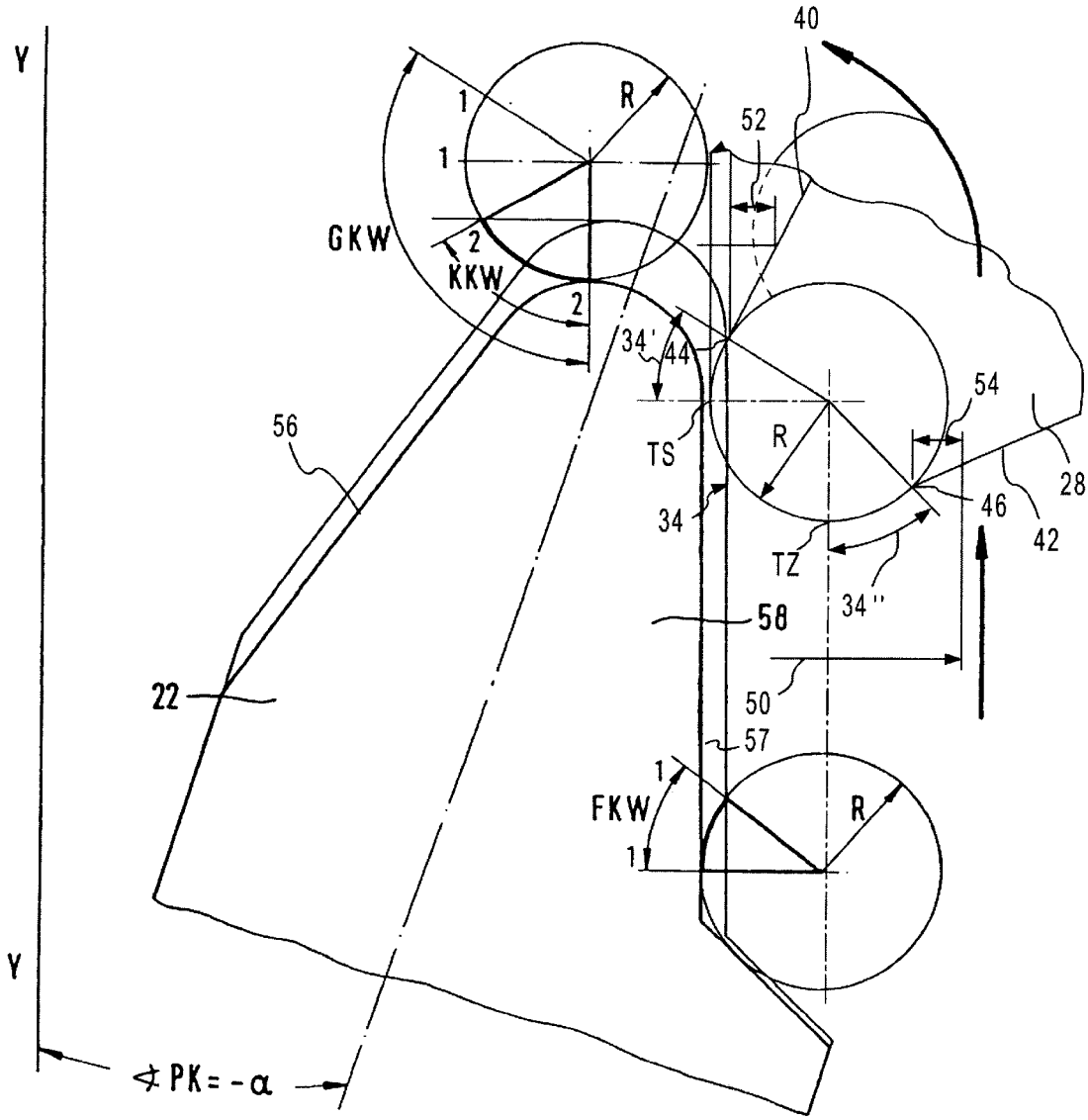

FIGS. 5*a*–5*c* show three different types of cutting blade which can be ground using the method according to the invention on a machine according to FIG. 1, with the left-hand side of each figure showing the arrangement of the cutting blade in a cutter head and the right-hand side showing the arrangement of the cutting blade in the clamping fixture of the grinding machine;

FIG. 6*a* shows the cut distribution on a cutting blade with different stock removal at the blade shoulder and at the blade tip;

FIG. 6*b* shows the cut distribution on a cutting blade with approximately constant stock removal at the blade shoulder and at the blade tip;

FIG. 7 shows the use of the method according to the invention for rough grinding the surface of a cutting blade in two operations;

FIG. 8 shows the use of the method according to the invention for finish grinding the same surface as in FIG. 7;

FIG. 9 shows the grinding of a shoulder on a cutting blade by means of the grinding wheel according to the invention, on the grinding machine type B22 with further developed software;

FIG. 10 shows the various possible grinding positions for different process phases for grinding a cutting blade by means of the grinding wheel according to the invention;

FIG. 11 shows the rough grinding of a relief flank on a cutting blade by means of the grinding wheel according to the invention;

FIG. 12 shows the finish grinding of the same relief flank as in FIG. 11 by means of the grinding wheel according to the invention;

FIG. 13 shows the determination of the working area of the grinding wheel during roughing;

FIG. 14 shows an explanatory drawing of how a total contact angle GKW is shifted by changing a profile tilting angle PKW;

FIG. 15 shows the determination of the working area of the grinding wheel according to the invention during finishing;

FIG. 16*a* shows the conditioning of a dressable grinding wheel by means of a contour roller on being applied to the grinding wheel contour; and FIG. 16*b* shows the conditioning of a grinding wheel according to the invention by means of a dressing roller by interpolation around the grinding wheel contour.

FIG. 1 shows a type B22 blade grinding machine of the applicant, referred to as a whole as 20. This machine is actually provided for grinding bar blades by means of profiled wheels in a form grinding process. Here, however, it has been expanded for grinding cutting blades, particularly cemented carbide blades, in a generating grinding process. The expansion primarily comprises an expansion of the software for controlling the blade grinding machine 20, especially in the area of adaptive control (PMC), the machining cycles and macros of the CNC, the user interface and the data management with an integrated PC. The CNC functions as the "master" and serves for the axis control, the execution of the parts programs (process sequence control), parts program administration, and for CNC screen displays. The adaptive control, also referred to as programmable controller, takes over the interface function between the CNC and the blade grinding machine, the control of the machine operating sequences, monitoring functions, machine operator's panels, digital input/output and interface to the robot/hopper. Due to the available resources (RAM in the PC) a program for the user interface is set up for each of the two grinding processes (form grinding and generating grinding). The switchover between the user interface for the form grinding or the generating grinding can be made during the startup phase of the PC software. The blade shape is generated only with the linear axes X, Y, Z. An A and a C-axis serve solely as adjustment axes and are positioned before the actual generating grinding of the blade surfaces. The path calculation and cut distribution are performed on the PC so that only macros and cycles for workpiece exchange and conditioning of the grinding wheel have to be provided on the CNC level. The main interpolation plane for grinding the cutting blades is formed by the axes Y and Z.

The workpiece spectrum encompasses cutting blades 22, of which three different types are depicted in FIGS. 5*a*–5*c*. The constructional geometry and the arrangement in a cutter head 24 are different in the three types of blade. Accordingly, the three types of blade are ground in three different clamping fixtures 26. The left-hand part of FIG. 5*a* shows a relief angle of 8° and a blade inclination angle of 20° in the cutter head. Accordingly, the cutting blade 22 on the right in FIG. 5*a* must have an angle of inclination of 28° in the clamping fixture 26 in order for the head of the blade to be arranged for grinding with no relief angle. This is true analogously for FIGS. 5*b* and 5*c*. The angles shown to the far left and at the upper left in FIGS. 5*a* and FIG. 5*c* are not of interest for the present description and therefore do not require further explanation. In generation of the surface on the cutting blade 22, the stock removal is carried out only by infeed in the Y-axis of the machine, as is suggested in FIGS. 1 and 5*a*.

The properties of the A-axis of the blade grinding machine 20 shown in FIG. 1 are an important prerequisite for the method described here, which has been especially developed for grinding cemented carbide. In the conventional form grinding method the A-axis serves only for positioning the apparatus and it is then fixed. The head radius is produced by at least two translational movements (Y, Z). These translational movements are described in greater detail further below with reference to FIGS. 7–15.

Figure 2:
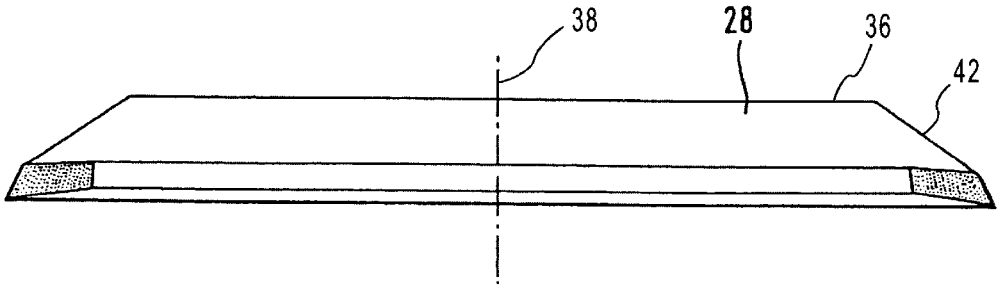
FIG. 2 shows a schematic drawing of a cup-type grinding wheel for the method according to the invention.

The generating grinding process described here is performed with a grinding wheel 28 which has an axis of rotation 38, and which is preferably a diamond cup-type grinding wheel. An axial cross section of the grinding wheel 28 is schematically represented in FIG. 2, and an enlarged portion thereof is shown in its working position in FIG. 3. In the embodiment shown in FIG. 3 and described here, the grinding wheel 28 comprises a steel carrier body 30 onto which an abrasive coating 32 comprising grit and a galvanic bonding is applied. The galvanic bonding consists of nickel that has been electrolytically deposited onto the steel carrier body 30 in galvanic baths. The diamond grains (not individually shown) protrude from the bonding that exists on conclusion of the galvanic treatment. A dressable grinding wheel could be bonded with synthetic resin.

In addition, reference is made to FIG. 4, which shows an even greater enlargement of a working area 34. The grinding wheel 28 has a grinding radius or radius of curvature R. One part 34' of the working area 34 is located in a face area and one part 34" of the working area 34 is located in a cylinder area of the grinding wheel 28. The face area of the grinding wheel 28 is that area which one sees looking onto the grinding wheel 28 from the left side in FIG. 4. The face area extends in the sectional view in FIG. 4 radially outward to a point Tz. The cylinder area of the grinding wheel 28 is that area which one sees looking onto the grinding wheel in FIG. 4 from below. The cylinder area extends over the grinding wheel height SH to the point Ts. Thus the part 34' of the working area 34 which is located in the face area of the grinding wheel 28 extends from a point 44 to the point Tz, whereas the part 34", which is located in the cylinder area, extends from a point 46 to the point Ts. The part of the working area 34 which is situated between the points Ts and Tz, thus is located both in the face area and in the cylinder area. The grinding wheel 28 has a fixed geometry and can not be dressed. If the service life has come to an end, the working area 34, i.e. the active surface of the grinding wheel, can be recoated.

Figure 3:
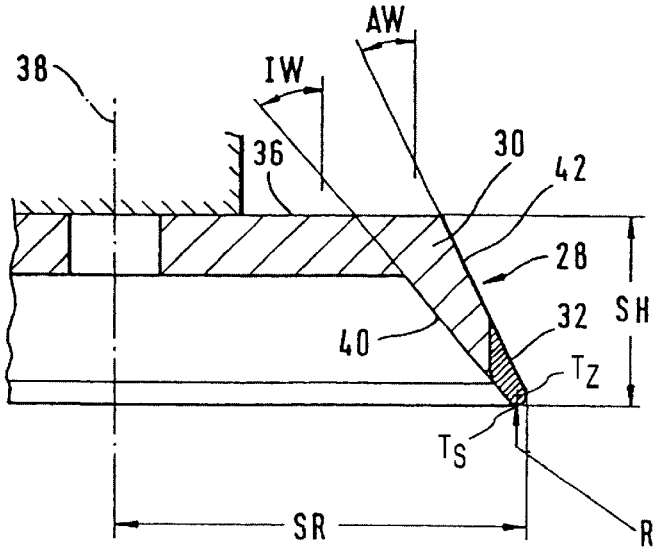
FIG. 3 shows an explanatory drawing of the grinding wheel according to the invention.

According to the drawing in FIG. 3, the grinding wheel 28 has a grinding radius or radius of curvature R at the grinding edge; a wheel radius SR up to a tangent to the grinding edge at the point Tz, which tanaent is parallel to the axis 38; a wheel height SH from a spindle contact surface 36 up to a tangent to the grinding edge at the point Ts, which tanaent is perpendicular to the axis 38; an inner angle IW of an inner surface (cone) 40 to the axis 38 of the grinding wheel 28; and an outer angle AW of an outer surface (cone) 42 to the axis 38. The working area 34 of the grinding wheel 28 comprises an annular surface extending as shown in FIG. 4 from a point 44 in the face area to a point 46 in the cylinder area of the grinding wheel 28, and having an arcuate profile in its axial cross section shown in FIG. 4, that extends over a total contact angle GKW, which is shown in FIGS. 13 to 15 and which will be described in greater detail with reference to these figures. The total contact angle GKW amounts to approximately 145°. The arcuate profile is in the shape of a circular arc, and the radius of curvature lies within a range of from 0.5 to 5 mm, preferably from 0.5 to 1 mm.

The grinding wheel has one and the same abrasive coating in the entire working area 34. That is, the different parts of the working area do not have to be provided with different coatings for use in roughing or finishing. The respective coating boundaries of the working area 34 are referred to as 48 and 50 in FIG. 4. The excess length by which the coating boundary extends beyond the actual working area is designated as 52 and 54, respectively. The angle within which the grinding wheel 28 can enter into contact with the head of the cutting blade 22 during the grinding is referred to as the head contact angle KKW. The head contact angle for use of the grinding wheel 28 in roughing corresponds to the part 34" of the working area; and the one for finishing corresponds to part 34' of the working area, as indicated in FIG. 4. The utilization of these different parts of the working area for roughing and/or finishing is described in greater detail below.

A cutting blade on which grinding is to be performed has three active surfaces, namely two relief flanks or surfaces 56, 57 (of which, for example, only relief surface 56 is completely visible in FIG. 5*a*) and a rake flank or surface 58. These three surfaces can be separately defined on the blade grinding machine 20 and subsequently ground separately. Each relief flank 56, 57 can comprise two different surfaces (with two different relief angles and with two geometries), namely the relief surface 56 or 57 itself and a bevel or facet 56' or 57', respectively, which is ground adjacent to the cutting edge and shown on the left side in FIG. 5*a*. The technological process can include a plurality of roughing cuts and one finishing cut. The finishing cut is used to produce the facet 56' or 57'. Each process phase (roughing or finishing) or spark-out can be defined separately.

The roughing and the finishing techniques for producing the relief surface 57 are schematically represented in FIGS. 13, 14 and 15. In the roughing (FIGS. 13 and 14) the cutting blade 22 is inclined by a profile tilting angle PK, so that the cutting blade is put into contact with the part 34" of the working area 34 in the cylinder area of the grinding wheel 28. The relief surface 57 which is thereby generated on the cutting blade 22 becomes concave on the flank and cylindrical at the head 23 of the cutting blade 22. The generating grinding method described here provides for the "roughing relief surface 57" to be ground with a larger relief angle than the "finishing relief surface 57." FIGS. 13 and 14 clearly show that the total contact angle GKW depends on the profile tilting angle PK. The profile contact angle PKW lies within a range of alpha to 90°-alpha. For different profile tilting angles PK the different parts 34', 34" of the working area 34 of the grinding wheel 28 are contacted with the cutting blade 22. In this manner the roughing part 34" and the finishing part 34' of the work area 34 of the grinding wheel 28 can be displaced relative to one another or even separated. The separation limit lies at PK=90°-alpha (with different grinding methods: thrust or pull).

For the finish grinding phase, described with reference to FIG. 15, the blade profile is vertically positioned (PK=-alpha). The grinding wheel 28 machines the flank (relief surface 57) of the cutting blade 22, wherein the generatrix is an arc in a plane. A planar or a cylindrical facet 57' is produced on the flank (relief surface 57), the width of which is calculable. However, no theoretically exact cylinder is produced on the head 23 of the cutting blade 22, but a correct cutting edge is given. The "finishing relief angle" set is smaller than the one set for the roughing. Thus, the two different surfaces 57, 57' are generated. Of course, the value of the "finishing relief angle" must be right for the machining process. As mentioned above, the different areas 34" and 34' of the grinding wheel 28 are utilized by differing the position the cutting blade 22 during roughing and finishing, respectively. This will result in increased service life. If the profile tilting angle PK is less than 90°-alpha, there will always be an area of overlap between roughing and finishing.

FIG. 6 shows the cut distribution for a blade machining in which the stock removal takes place solely by infeed in the Y-axis of the machine. In this process the stock removal at the blade shoulder 21 and at the blade tip 23 is substantially greater than on the lateral or relief surfaces 56, 57. If the grinding technique dictates that the stock removal be approximately constant, a suitable cut distribution must be calculated. Additional intermediate positions must then be converted in the proper order into a CNC parts program with the correct sequence of grinding operations. The additional grinding operations are marked by hatched lines in FIG. 6*b*.

The machining of the blade is described in greater detail below with reference to FIGS. 7 and 8, using the example of a surface roughed in two operations and subsequently finished. For the roughing in two operations, positions designated as 0–14 are approached with the cutting blade 22, which is clamped into the clamping fixture 26 (cf. FIG. 5*a*) not shown in FIGS. 7 and 8. The first operation is shown on the left in FIG. 7 and the second operation on the right. The grinding wheel 28 maintains its respective position, and the positions shown are approached by the cutting blade 22 itself, even though the illustration in FIGS. 7 and 8 is such that the grinding wheel 28 appears to move. However, as shown in FIG. 1, it can only move in the Y-axis. The clamping fixture 26 in which the cutting blade 22 is secured, carries out the movements in the X, the Z, and if necessary in the Y-axes.

In FIG. 7, 0 is the starting position that can be approached collision-free from a standard position. This position corresponds to X=0, Y=0, Z=O, with the effective zero displacement. The short-dashed arrows indicate fast-speed motion and the long-dashed arrows indicate feed rate. 1 designates the polygon point still approached at fast speed. 2–6 are the points on the path of the first operation that are approached at the rate of feed. Points 7 and 8 are intermediate points approached at fast speed. Points 9–14 are points on the path of the second operation that are approached at the rate of feed. The withdrawal to the standard position takes place at fast speed from point 14 onward.

0 in FIG. 8 again indicates the starting position which can be approached collision-free from a standard position. 1 is the first point on the path, which is still approached at fast speed. 2–6 are points on the path that are approached at the rate of feed. The withdrawal to the standard position takes place at fast speed from point 6 onward. FIGS. 9–12 show how the working operations schematically represented in FIGS. 7 and 8 are actually performed on the blade grinding machine 20.

The cutting blade 22 in FIG. 9 is set in such a manner that the grinding wheel 28 grinds the relief surface 57 of the cutting blade 22 using the part 34" of its working area located in the cylinder area. That is, it rough grinds the surface, starting from the shoulder 21 up to the head 23 of the cutting blade 22.

FIG. 10 shows the various possible grinding positions for different technological phases for grinding the cutting blade 22 with the grinding wheel 28.

According to the drawing of FIG.11, the other relief surface 56 of the cutting blade 22 is ground by means of the working area part 34" located in the cylinder area. Thus, it is likewise rough ground.

According to the drawing of FIG. 12, the previously roughed relief surface 56 of the cutting blade 22 is then put into a vertical position in which it is tangential to the face area of the grinding wheel 28. This surface 56 of the cutting blade 22 is finished in this position.

The setting of the blade in relation to the grinding wheel, which is movable in the Y-axis, will now be described in detail with reference to FIGS. 13–15. In each of the FIGS. 13–15, only the grinding edge of the grinding wheel 28 is suggested by a circle corresponding to the circle shown at the cutting edge in FIG. 4. The grinding wheel 28, which is not otherwise shown, has the same orientation as in FIG. 4, i.e. its face extends vertically and the axis of rotation 38 is horizontal.

The roughing and finishing techniques are schematically represented in FIGS. 13–15. In the roughing (FIGS. 13 and 14) the cutting blade 22 is inclined by the profile tilting angle PKW, so that the profile is put into contact with the cylinder area of the grinding wheel 28. In this manner the relief flank or surface 57 is generated which is concave on the flank and cylindrical at the head 23 of the cutting blade 22. Preferably, grinding on the "roughing relief surface" 57 is performed with a larger relief angle than on the "finishing relief surface" 57'. FIGS. 13 and 14 clearly show that the total contact angle GKW depends on the profile tilting angle PKW, as already explained further above.

The blade profile is vertically positioned (PK=-alpha) for the finishing phase (FIG. 15). The grinding wheel 28 works the flank of the cutting blade with its face, wherein the generatrix is an arc in a plane, as has likewise already been discussed.

As mentioned above, different parts 34', 34" of the working area 34 of the grinding wheel 28 are used by differing the position of the cutting blade 22 during roughing and finishing. Of course, the direction of feed (thrust or pull) figures significantly in this respect.

The above-described method of grinding at least one surface on a cutting blade 22 used in machining, using a grinding wheel 28 that rotates around the axis 38 and that has a working area 34 consisting of an annular surface with its axial cross section in the form of an arcuate profile (cf. particularly FIG. 4), can be summarized as follows:

a) First of all, a surface is generated on the cutting blade 22 by grinding with the annular surface during a first orientation in space between the grinding wheel 28 and the cutting blade 22 by means of at least one first relative translational movement between the grinding wheel and the cutting blade, as is shown for the surface 56 in FIG. 11, for example, and b) subsequently, at least one part of the generated surface 56 is reground with the annular surface during a second orientation in space between the grinding wheel 28 and the cutting blade 22 by means of at least one second relative translational movement between the grinding wheel 28 and the cutting blade 22, as represented in FIG. 12.

Preferably, in this connection, the first and the second spatial orientations between the grinding wheel 28 and the cutting blade 22 are obtained by setting a first and a second respective position of the cutting blade 22 in relation to the grinding wheel 28. Depending on the inclination of the cutting blade 22 in FIG. 12, the at least one part of the surface 56 produced is generated on the cutting blade 22 by the grinding wheel 28 as a concave or planar facet 56'. For practical purposes the stock removal during the generation of the surface on the cutting blade 22 occurs only through infeed in the Y-axis of the machine. It is essential to the invention that only relative translational movements between the cutting blade 22 and the grinding wheel 28 are performed. Neither the grinding wheel 28 nor the cutting blade 22 needs to be rotated during the work on the blade, except of course for the rotation of the grinding wheel 28 about its own axis 38. Here the surface 56 or 57 on the cutting blade 22 can be generated in step a) and/or in step b) in two operations by two first and two second relative translational movements between the grinding wheel 28 and the cutting blade 22, respectively.

It is already indicated above that the method is preferably carried out on a CNC machine and that a CDS computer system is used to determine interrelations between geometric and technological parameters for the generating grinding. In addition, on the basis of an example it has been described above that the surface 56, 57 on the cutting blade 22 is generated in step a) in two operations, that is with two roughing cuts. However, it is clear that at least one roughing cut is sufficient. The at least one part of the generated surfaces 56, 57 is then reground with a finishing cut in step b) to produce the facet 56' or 57', respectively.

The relative translational movement between the grinding wheel 28 and the cutting blade 22 is produced by imparting a thrust motion (such as that shown in FIGS. 13 and 14) or a pulling motion (such as that shown in FIG. 15) to the cutting blade 22 relative to the grinding wheel 28. The special advantage of the grinding wheel 28 used in the method described here is that the grinding wheel has the same specifications in its entire annular surface used for grinding, i.e. for example that the entire working area of the grinding wheel has one and the same abrasive coating, and that the roughing and finishing cuts are selected solely through selection of feed parameters such as direction and rate of feed, cutting speed and over measure.

The surface elements of the annular surface that are used in steps a) and b) for roughing and finishing, respectively, are interchangeable.

The method described here is preferably used for grinding cemented carbide blades by means of a diamond cup-type grinding wheel.

The grinding wheel 28 can be dressable or nondressable. If a dressable grinding wheel is used, the dressing could be carried out using the following methods: dressing with a contour roller 66 (FIG. 16*a*) having a negative correction. In this case, no further axial movements are necessary aside from the approach to the grinding wheel 28, or dressing with a contour roller 68 having a contour similar to that which is commonly used. In this case, a contour around the wheel profile has to be traced with the contour roller 68.

Due to the inclined dressing spindle axis, the commonly existing arrangement of the dressing unit can not be used for this. The control must be informed by a new input signal that the dressing device (contour roller 66 or 68) has been set up for the diamond cup-type grinding wheel, so that the software range limit switches can then be activated and additional monitoring and plausibility controls referring to the grinding process can be conducted. FIG. 16*a* schematically represents the conditioning by means of the contour roller 66, with linear interpolation on the approach to the grinding wheel contour. FIG. 16*b* shows the conditioning with the contour roller 68 by interpolation around the grinding wheel contour. In both cases the conditioning process can take place at different relative speeds of the contact points of the cup-type wheel to the dressing tool, to thereby achieve the desired surface quality or removal capacity of the grinding wheel 28. The actual dressing process will be a cycle which is on file in the CNC and which accesses the data of the tool database. The conditioning process according to FIG. 16*b* can be carried out if the condition for the radii and the steepness of the cone has been satisfied. Then, a theoretical punctual contact occurs between the grinding wheel 28 and the dressing roller 68. The dressing cycle is to be set up in such a manner that a dressing roller with a cylindrical part and with one radius each can be applied at the edge.

As described above at least two translational movements are necessary, namely one for the flank of the cutting blade 22 and one for the head 23 of the cutting blade 22. However, an additional, third translational movement could also be used.

The optimization carried out in the generating grinding method described here, for example, can consist in that the force on the grinding surface stays constant. To achieve this optimization it is possible, for example, to design the surfaces on the cutting blade 22 such that the cutting output of the grinding wheel 28 always stays the same. The grinding wheel manufacturer generally recommends a certain cutting output, which should be observed. It is then possible for the user to adapt the blade surfaces to be ground to this. A controlled cut distribution such as that described above with reference to FIGS. 6*a* and 6*b* enables an improved optimization of the grinding process, namely uniform output or forces, production of a desired facet width, etc.

A further optimization consists in that the final state of the ground surface can optionally be planar or concave and that each relief flank in turn can comprise a combination of two clearance areas. For this, it is only necessary to select the orientation in space between the grinding wheel 28 and the cutting blade 22 accordingly, combined with a thrust or pulling motion of the cutting blade 22, as explained above. Thus, the method described here is extremely flexible.

As is apparent from the preceding description, a grinding wheel 28 that rotates around an axis 38 and that has a working area consisting of an annular surface with a circular arc profile in axial cross section is used to first generate a surface 56 or 57 on a cutting blade 22 by grinding with the annular surface during a first orientation in space between the grinding wheel 28 and the cutting blade 22 by means of executing at least one first relative translational movement between the same, and subsequently at least one part of the generated surface is reground with the annular surface during a second orientation in space between the grinding wheel 28 and the cutting blade 22 by means of executing at least one second relative translational movement between the same to generate a facet 56' or 57', respectively. The grinding wheel 28 is a diamond cup-type grinding wheel. One part 34' of the working area 34 is located in a face area and another part 34" is located in a cylinder area of the grinding wheel 28. The part 34" is used for rough grinding and the part 34' is used for finish grinding of the surface 56 or 57 to be generated on the cutting blade 22. The grinding wheel 28 has the same abrasive coating for the entire working area 34. Thus roughing and finishing are performed with different grinding parameters but using areas of the grinding wheel that have the same specifications. Preferably, the spatial orientation between the grinding wheel 28 and the cutting blade 22 is selected by adjusting the cutting blade in relation to the grinding wheel. The method enables planar and/or concave surfaces 56, 56', 57, 57' to be generated on a cutting blade. It also enables a simpler sequence of operations and permits a grinding wheel to be used which has a simpler configuration than in the state of the art.

What is claimed:

1. A method for grinding at least one surface on a cutting blade (22) used in machining, with a cup-type grinding wheel (28) that rotates around an axis (38) and comprises a face area, a cylinder area and a wheel height (SH) measured parallel to the axis, the grinding wheel (28) having a working area (34) extending into the face area and into the cylinder area of the grinding wheel, the working area consisting of an annular surface having a circular arc profile in axial cross section, wherein the face area extends from the axis (38) to a point (Tz) on the circular arc profile having a tangent which is parallel to the axis (38) and wherein the cylinder area extends through the wheel height (SH) to a point (Ts) on the circular arc profile having a tangent which is perpendicular to the axis (38), comprising the steps of:

a) generating a surface on the cutting blade (22) by grinding with the annular surface during a first orientation in space between the grinding wheel (28) and the cutting blade (22) by executing at least one first relative translational movement between the grinding wheel (28) and the cutting blade (22), and b) regrinding at least one part of the generated surface with the annular surface during a second orientation in space between the grinding wheel (28) and the cutting blade (22) by executing at least one second relative translational movement between the grinding wheel (28) and the cutting blade (22).

2. The method according to claim 1, characterized in that in the step a) the first orientation in space between the grinding wheel (28) and the cutting blade (22) is obtained by setting a first position of the cutting blade (22) in relation to the grinding wheel (28), and in that in the step b) the second orientation in space between the grinding wheel (28) and the cutting blade (22) is obtained by setting a second position of the cutting blade (22) in relation to the grinding wheel (28).

3. The method according to claim 2, characterized in that the first position of the cutting blade (22) is selected such that the grinding wheel (28) generates the surface on the cutting blade (22) with a portion of the annular surface located in the cylinder area of the grinding wheel (28), and in that the second position of the cutting blade (22) is selected such that the grinding wheel (28) grinds the at least one part of the surface generated on the cutting blade (22) with a second portion of the annular surface located in the face area of the grinding wheel (28).

4. The method according to claim 3, characterized in that the second position of the cutting blade (22) is selected such that the grinding wheel (28) generates the at least one part of the surface generated on the cutting blade (22) as a concave facet.

5. The method according to claim 1, characterized in that the stock removal during generation of the surface on the cutting blade (22) occurs only through infeed in a Y-axis of the machine.

6. The method according to claim 1, characterized in that the surface on the cutting blade (22) is generated by relative translational movement along at least one of three mutually orthogonal linear axes (X, Y, Z), and any rotational movement about other axes (C, A) is utilized for adjusting and positioning the cutting blade (22) relative to the grinding wheel (28) prior to generating the surface on the cutting blade (22).

7. The method according to claim 1, characterized in that the surface on the cutting blade (22) is generated by executing two relative translational movements between grinding wheel (28) and cutting blade (22).

8. The method according to claim 1, characterized in that the method is carried out by using a CNC blade grinding machine (20).

9. The method according to claim 8, characterized in that a CDS computer system is used to determine interrelations between geometric and technological parameters for the grinding.

10. The method according to claim 1, characterized in that the surface on the cutting blade (22) is generated in step a) with at least one roughing cut, and in that the at least one part of the generated surface is reground in step b) with a finishing cut.

11. The method according to claim 1, characterized in that the relative translational movement between the grinding wheel (28) and the cutting blade (22) is produced by imparting a thrust or pulling motion to the cutting blade (22) relative to the grinding wheel (28).

12. The method according to claim 10, characterized in that in regrinding the at least one part of the generated surface with the finishing cut, a pulling motion relative to the grinding wheel (28) is imparted to the cutting blade (22).

13. The method according to claim 10, characterized in that the grinding wheel (28) has the same specifications throughout it's the annular surface used for grinding, and in that the roughing and finishing cuts are executed by selecting at least one feed parameter of the group consisting of direction of feed, rate of feed, overmeasure, and grinding speed.

14. The method according to claim 10, characterized in that in the roughing and finishing cuts in steps a) and b), respectively, different portions of the annular surface are used for grinding, and those different portions of the annular surface are interchangeable.

15. The method according to claim 1, characterized in that a diamond grinding wheel (28) is used to grind cemented carbide cutting blades (22).

16. The method according to claim 1, characterized in that the grinding wheel (28) comprises a diamond grinding wheel, and the working area (34) has one part (34') located in the face area and another part (34") located in the cylinder area.

17. The method according to claim 16, characterized in that the circular arc profile extends over a total contact angle (GKW).

18. The method according to claim 17, characterized in that the total contact angle (GKW) is approximately 145°.

19. The method according to claim 16, characterized in that the circular arc profile has a radius of curvature (R) within a range of 0.5 to 5 mm.

20. The method according to claim 16, characterized in that the grinding wheel (28) has a fixed geometry and is nondressable.

21. The method according to claim 20, characterized in that the grinding wheel (28) comprises a metallic carrier body (30) onto which an abrasive coating (32) of diamond grit and a galvanic bonding is applied, with the diamond grit protruding from the galvanic bonding.

22. The method according to claim 16, characterized in that the circular arc profile has a radius of curvature (R) within a range of 0.5 to 1 mm.

23. The method according to claim 3, characterized in that the second position of the cutting blade (22) is selected such that the grinding wheel (28) generates the at least one part of the surface generated on the cutting blade (22) as a planar facet.

24. The method according to claim 7, characterized in that the at least one part of the generated surface on the cutting blade (22) is reground by executing two relative translational movements between grinding wheel (28) and cutting blade (22).

* * * * *